US007343885B1

(12) United States Patent
Marley

(10) Patent No.: US 7,343,885 B1
(45) Date of Patent: Mar. 18, 2008

(54) CRANKCASE VENTILATION SYSTEM FOR INTERNAL COMBUSTION ENGINE

(75) Inventor: Michael Patrick Marley, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/685,954

(22) Filed: Mar. 14, 2007

(51) Int. Cl.
*F01M 13/00* (2006.01)

(52) U.S. Cl. ..... 123/41.86

(58) Field of Classification Search ..... 123/41.86, 123/572

See application file for complete search history.

(56) References Cited

U.S. PATENT DOCUMENTS 4,197,703 A * 4/1980 Holmes ..... 60/319
4,557,226 A * 12/1985 Mayer et al. ..... 123/41.86
6,439,174 B1 8/2002 Shea et al.
6,647,973 B1 * 11/2003 Schueler et al. ..... 123/572
6,694,957 B2 * 2/2004 Schueler et al. ..... 123/572

* cited by examiner

*Primary Examiner*—Hai Huynh
(74) *Attorney, Agent, or Firm*—Carlos L. Hanze; Dickinson Wright PLLC

(57) ABSTRACT

A crankcase ventilation system for a reciprocating internal combustion engine includes an exhaust outlet and a collector for gathering gases from the engine crankcase. An eductor is connected to the collector and to the exhaust outlet. The eductor includes a generally cylindrical body extending into the exhaust passage of the exhaust outlet and having discharge, clean out, and receiver ports, so that crankcase gases will be drawn through the eductor and discharged into exhaust flowing through the exhaust outlet.

19 Claims, 3 Drawing Sheets

CRANKCASE VENTILATION SYSTEM FOR INTERNAL COMBUSTION ENGINE

BACKGROUND OF THE INVENTION

1. Field of the Invention

The present invention is related to a crankcase ventilation system for a reciprocating internal combustion engine, and more particularly to an internal combustion engine suitable for installation in a railroad locomotive.

2. Disclosure Information

Reciprocating internal combustion engines utilize one or more cylinders for the purpose of generating power at a crankshaft. Because combustion is accompanied by very high pressures, some gases inevitably escape from the engine's cylinder(s) and leak between the reciprocating pistons and the cylinder walls. These gases, commonly termed "blow-by", must be evacuated from the engine's crankcase, because without evacuation crankcase pressure will build and cause expulsion of lubricating oil past various seals.

With some non-boosted internal combustion engines, particularly throttled engines, it is possible to draw crankcase gases into the engine's induction system by naturally occurring vacuum. With certain other engines having boosting—in other words, engines which are turbocharged or supercharged, or even unthrottled engines, the intake system does not operate at a sub-atmospheric pressure and as a result, it is difficult to entrain blow-by gases into the intake.

Railroad locomotives frequently use a system called an eductor for conveying the blow-by gases from the prime mover—most often a diesel engine—to the exhaust stream exiting the engine. Unfortunately, the environment of the exhaust system causes carbonaceous material to be built up on the eductor. Such material must be removed periodically to prevent buildup of a sufficient cake of material that a fire hazard is posed to vegetation or structures adjoining railroad tracks upon which a locomotive is operating. This risk arises when a superheated piece of carbonaceous material is discharged from the locomotive only to fall upon dried grass, other vegetation, or a structure. Problems with caked materials forming within a crankcase gas eductor may be mitigated with regular cleaning of the eductor. Such a remedy poses a problem in the context of railroad locomotives, because eductors are generally mounted near the uppermost part of locomotives at the top of the internal combustion engine, with the eductor extending into an exhaust stack.

Cleaning the eductor requires either that the plumbing attached to the eductor be removed, a difficult task in the environment of a railroad locomotive, or that the eductor be cleaned by reaching down from the top of the locomotive thereby potentially imperiling the person performing the maintenance.

It would be desirable to have an eductor which is readily serviceable, so as to promote frequent cleaning, and which provides additional flow because of vacuum amplification.

SUMMARY OF THE INVENTION

According to an aspect of the present invention, a crankcase ventilation system for a reciprocating internal combustion engine includes an exhaust outlet, a collector for gathering gases from an engine crankcase, and an eductor connected to the collector and to the exhaust outlet. The inductor includes a generally tubular or cylindrical body extending into an exhaust passage of the exhaust outlet, with the generally tubular body having a central passage. A discharge port is defined at an inner end of the central passage, and a cleanout port is defined at an outer end of the central passage. A receiver port communicates with the central passage. The receiver port is positioned between the discharge port and the cleanout port. The receiver port is also connected with the collector so that crankcase gases will be drawn through the eductor and discharged into exhaust flowing to the engine's exhaust outlet.

According to another aspect of the present invention, a crankcase ventilation system may include a vacuum intensifier operatively connected with the inductor. The vacuum intensifier directs an auxiliary airflow into the eductor's central passage. The vacuum intensifier may include a nozzle mounted in an outer wall of the eductor's generally tubular body.

According to another aspect of the present invention, an auxiliary airflow may be furnished by means of a charge air booster such as a turbocharger or a supercharger.

According to another aspect of the present invention, a collector incorporated in the present system preferably includes a coalescer for separating liquids from the crankcase gases, and a conduit for conveying the gases to the eductor.

The cleanout port incorporated in the eductor's body preferably includes a port which is coaxial with the eductor's central passage, which has a manually removable access plug.

According to another aspect of the present invention, in order to promote free flow of the crankcase gases through the eductor, a feeder port has a central axis intersecting with the central axis of the eductor's central passage at an acute angle.

According to another aspect of the present invention, a railroad locomotive is powered by an internal combustion engine having a crankcase, an exhaust muffler, a collector for gathering gases from the crankcase, and an eductor connected to the collector and to the muffler, with the eductor including a generally cylindrical body extending into an exhaust passage of the exhaust muffler, and with a generally cylindrical body having a central passage. A discharge port is defined in an inner end of the central passage, and a cleanout port which is manually openable, is defined in another end of the central passage. A receiver port communicates with the central passage. The receiver port is positioned between the discharge port and the cleanout port and connected with the collector so that crankcase gases will be drawn through the eductor and discharged into exhaust flowing into the exhaust muffler. A vacuum intensifier includes high pressure air discharging into the eductor's central passage from a nozzle mounted through an outer wall of the eductor's generally cylindrical body. As described above, the high pressure air may be furnished either by turbocharger, supercharger, or some other type of air compressor. Moreover, the muffler may be attached to an exhaust outlet of a turbocharger.

It is an advantage of the present crankcase ventilation system that the eductor may be readily cleaned, so as to prevent excessive pyrolizing and caking of carbonaceous materials upon the eductor, followed by unwanted random release of pyrolized material.

It is yet another advantage of a crankcase ventilation system according to the present invention that a vacuum intensifier promotes the flow of crankcase gases so as to maintain the crankcase at a pressure level which prevents the expulsion of lubricating oil from various seals of the crankcase.

It is another advantage of a crankcase ventilation system according to the present invention that the eductor may be cleaned safely, and without the use of tools other than a furnace brush.

It is another advantage of a crankcase ventilation system according to the present invention that the eductor may be inspected without disassembling any portion of either a locomotive or the engine upon which the eductor is installed.

Other advantages, as well as features and objects of the present invention will become apparent to the reader of this specification.

DETAILED DESCRIPTION OF THE PREFERRED EMBODIMENTS

Figure 1:
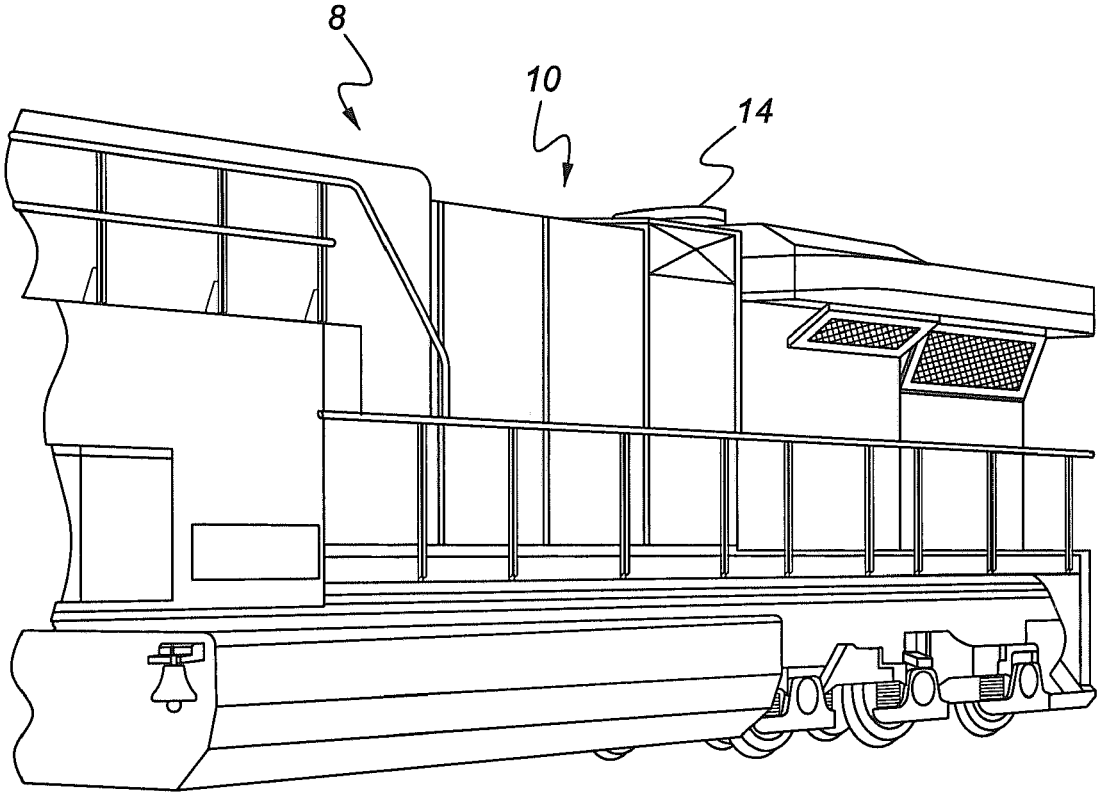
FIG. 1 is a perspective view of a railroad locomotive having a crankcase ventilation system according to the present invention.
Figure 2:
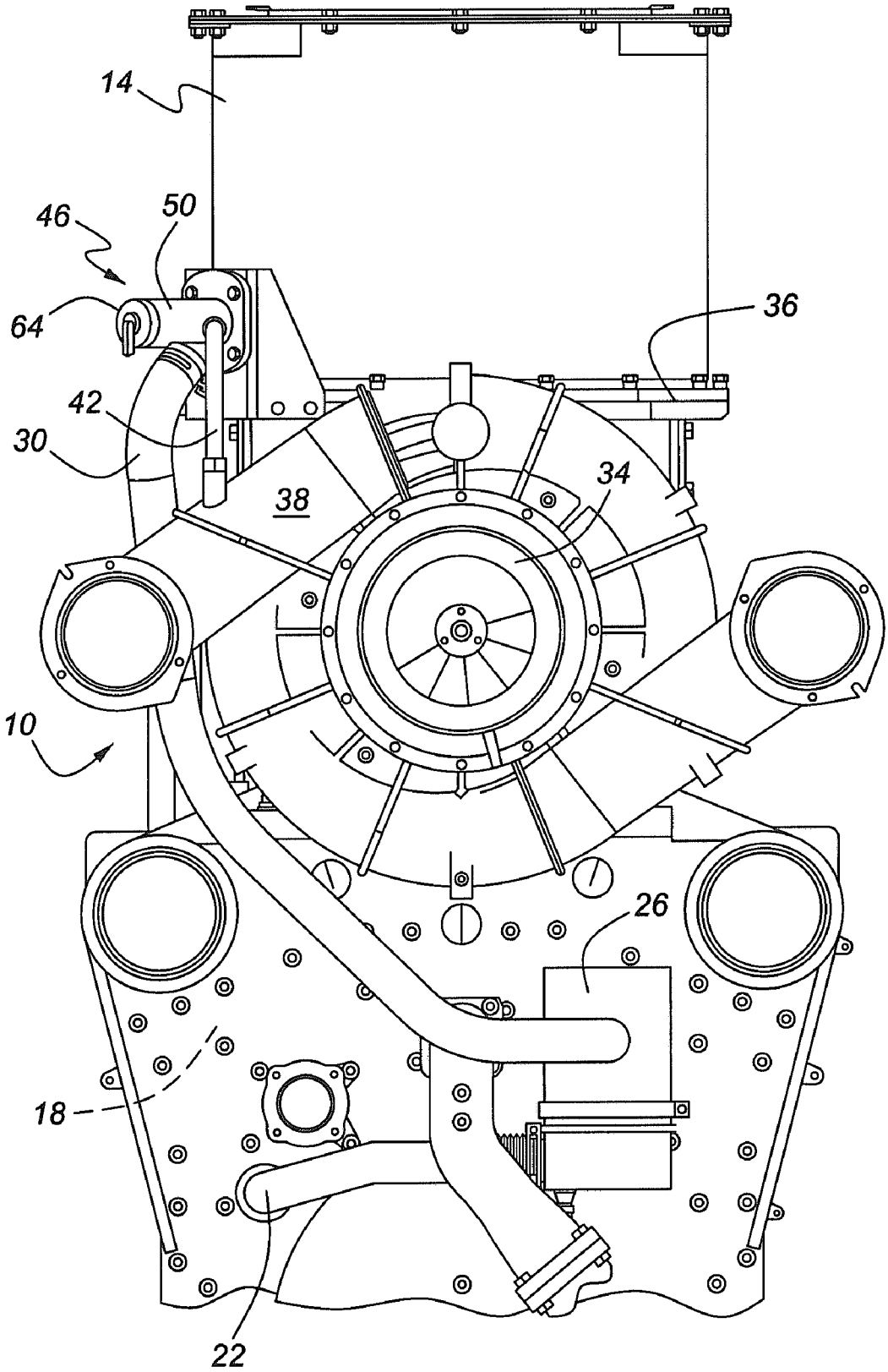
FIG. 2 is an end view of an internal combustion engine suitable for use in the locomotive of FIG. 1 and having the present crankcase ventilation system.
Figure 3:
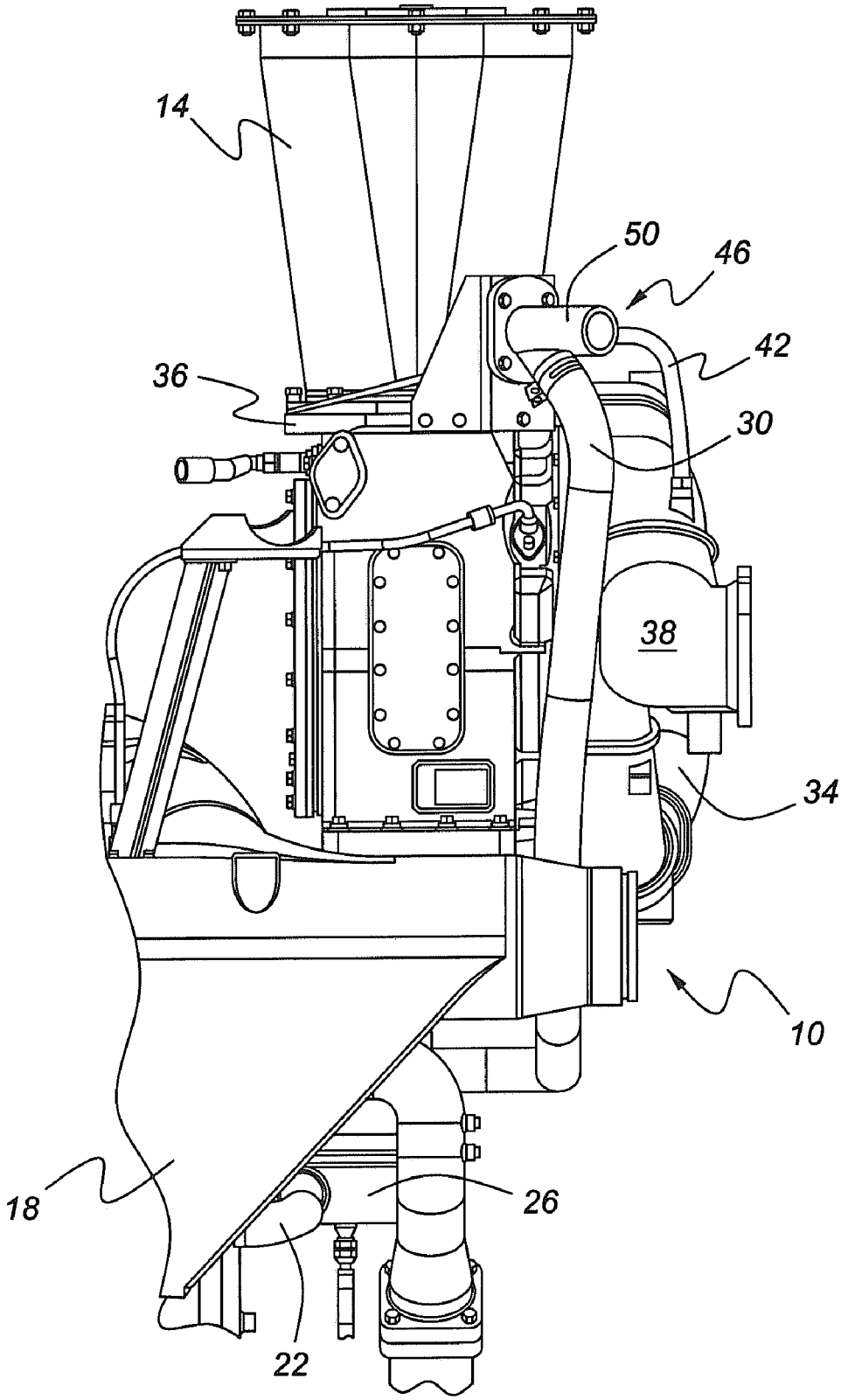
FIG. 3 is a side view of a portion of the engine shown in FIG. 2.

As shown in FIGS. 1-3, locomotive 8 has internal combustion engine 10, which is illustrated as a reciprocating diesel engine having an exhaust outlet, 14.

FIGS. 2 and 3 show details of exhaust outlet 14 of engine 10, which is illustrated as being a muffler. Exhaust outlet 14 is bolted to the exhaust outlet flange 36 of a charge air booster 34. Booster 34 may be either a turbocharger or a supercharger. A collector which gathers gases from engine crankcase 18 includes source tube 22, and a gas conduit 30. Coalescer 26 is interposed between source tube 22 and gas conduit 30. Coalescer 26 functions to separate liquids, such as oil droplets, from crankcase gases. The reconstituted oil is returned to engine crankcase and gases are sent to eductor 46.

As is further shown in FIGS. 2 and 3, eductor 46 is mounted on an upper portion of engine 10 and extends into exhaust outlet or muffler 14. FIGS. 2 and 3 also show air supply tube 42 which extends between a turbo outlet pipe, 38, and eductor 46.

Figure 4:
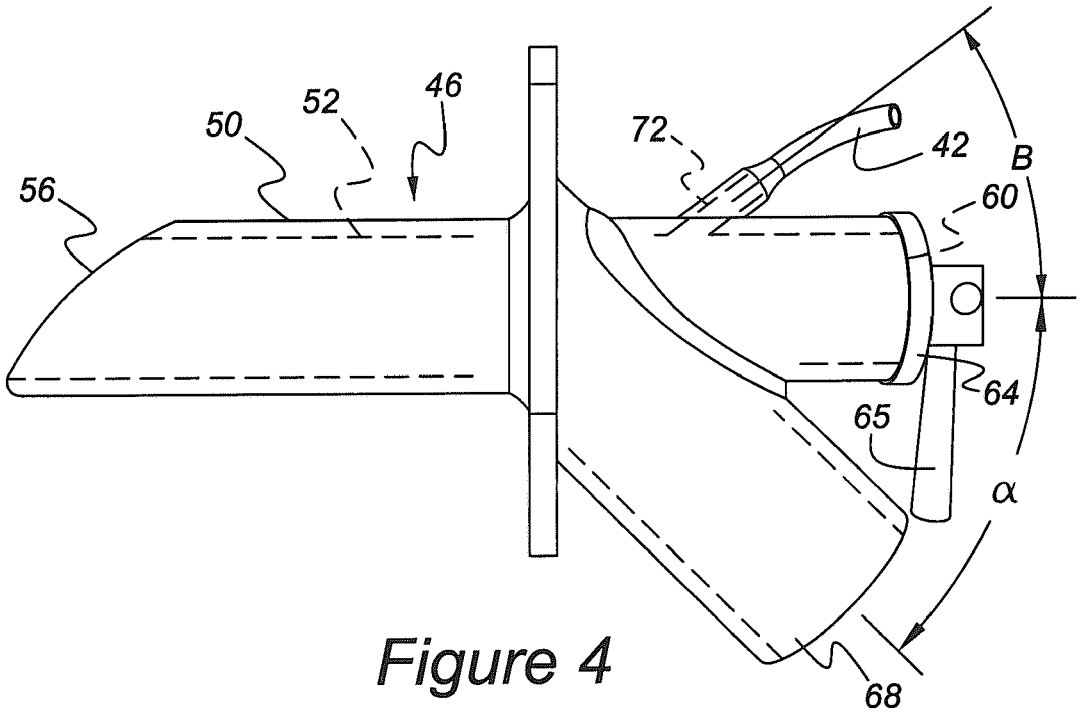
FIG. 4 is a perspective view of an eductor forming of a portion of a crankcase ventilation system according to an aspect of the present invention.

FIG. 4 illustrates several details of construction of eductor 46. Generally cylindrical or tubular body 50 has a central passage, 52, extending the length of generally cylindrical body 50. A discharge port 56, is defined at the inner end of central passage 52. Discharge port 56 is angled so that exhaust gases flowing upwardly over eductor 46 will cause a low pressure area at the discharge port, aiding the removal of crankcase gases from crankcase 18.

Cleanout port 60, formed in generally cylindrical body 50, is closed by means of a manually operable plug, 64, which is readily removable, and allows the entirety of central passage 52 to be cleaned by means of a furnace brush or other type of implement. Although plug 64 is shown as being removable by means of toggle handle 65, those skilled in the art will appreciate in view of this disclosure that other types of readily removable plugs could be employed as part of the present invention.

Receiver port 68 of eductor 46 is shown in FIG. 4 as having a central axis intersecting with the central axis of central passage 52 at an acute angle, $\alpha$, which allows blow-by gases to be readily moved through eductor 46. This flow may be aided by optional use of nozzle 72 which is connected with turbo outlet pipe 38 by means of air supply tube 42. Nozzle 72, hose 42, and indeed, turbocharger or booster 34 all function as a vacuum intensifier which is particularly useful for accelerating the flow of crankcase gases through eductor 46. Nozzle 72 has a central axis intersecting with the central axis of said central passage at an acute angle, $\beta$ (FIG. 4).

As mentioned above, eductor 46 is mounted within muffler 14 so that the generally tubular or cylindrical body, 50, of eductor 46 extends into exhaust outlet 14 in a direction generally perpendicular to the direction of the bulk flow of the exhaust gases through the exhaust outlet. In this manner, a maximum level of vacuum is generated within central passage 52 of eductor 46.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A crankcase ventilation system for a reciprocating internal combustion engine, comprising:

an exhaust outlet;

a collector for gathering gases from an engine crankcase; and an eductor connected to said collector and to said exhaust outlet, with said eductor comprising:

a generally tubular body extending into an exhaust passage of said exhaust outlet, with said generally tubular body having a central passage;

a discharge port defined at an inner end of said central passage;

a cleanout port defined at an outer end of the central passage; and a receiver port communicating with said central passage, with said receiver port being positioned between said discharge port and said cleanout port, and with said receiver port being connected with said collector, so that crankcases gases will be drawn through said eductor and discharged into exhaust flowing through the exhaust outlet.

2. A crankcase ventilation system according to claim 1, further comprising a vacuum intensifier operatively connected with said eductor.

3. A crankcase ventilation system according to claim 2, wherein said vacuum intensifier comprises an auxiliary air flow directed into said central passage.

4. A crankcase ventilation system according to claim 2, wherein said vacuum intensifier comprises an auxiliary air flow directed into said central passage through a nozzle mounted in an outer wall of said generally tubular body.

5. A crankcase ventilation system according to claim 4, wherein said auxiliary air flow is furnished by a charge air booster.

6. A crankcase ventilation system according to claim 4, wherein said auxiliary air flow is furnished by a turbocharger.

7. A crankcase ventilation system according to claim 4, wherein said auxiliary air flow is furnished by a supercharger.

8. A crankcase ventilation system according to claim 4, wherein said nozzle has a central axis intersecting with the central axis of said central passage at an acute angle.

9. A crankcase ventilation system according to claim 1, wherein said collector comprises a coalescer for separating liquids from said crankcase gases, and a conduit for conveying said gases to said eductor.

10. A crankcase ventilation system according to claim 1, wherein said cleanout port comprises a port which is coaxial with said central passage and which has a manually removable access plug.

11. A crankcase ventilation system according to claim 1, wherein said receiver port has a central axis intersecting with the central axis of said central passage at an acute angle.

12. A crankcase ventilation system according to claim 1, wherein said generally tubular body extends into said exhaust outlet in a direction generally perpendicular to the direction of the bulk flow of exhaust gases through the exhaust outlet.

13. A crankcase ventilation system according to claim 1, wherein said exhaust outlet comprises a muffler.

14. A crankcase ventilation system according to claim 1, wherein said exhaust outlet comprises a muffler mounted on top of an engine.

15. A crankcase ventilation system for a reciprocating internal combustion engine, comprising:

an exhaust muffler;

a collector for gathering gases from an engine crankcase;

an eductor connected to said collector and to said muffler, with said eductor comprising:

a generally cylindrical body extending into an exhaust passage of said exhaust muffler, with said generally cylindrical body having a central passage;

a discharge port defined at an inner end of said central passage;

a cleanout port defined at an outer end of the central passage; and a receiver port communicating with said central passage, with said receiver port being positioned between said discharge port and said cleanout port, and with said receiver port being connected with said collector, so that crankcases gases will be drawn through said eductor and discharged into exhaust flowing through the exhaust muffler; and a vacuum intensifier comprising high pressure air discharging into said central passage from a nozzle mounted through an outer wall of said generally cylindrical body.

16. A crankcase ventilation system according to claim 15, wherein said high pressure air is furnished by a charge air booster.

17. A railroad locomotive powered by a reciprocating internal combustion engine, with said engine comprising:

a crankcase;

an exhaust muffler;

a collector for gathering gases from said crankcase;

an eductor connected to said collector and to said muffler, with said eductor comprising:

a generally cylindrical body extending into an exhaust passage of said exhaust muffler, with said generally cylindrical body having a central passage;

a discharge port defined at an inner end of said central passage;

a cleanout port defined at an outer end of the central passage; and a receiver port communicating with said central passage, with said receiver port being positioned between said discharge port and said cleanout port, and with said receiver port being connected with said collector, so that crankcases gases will be drawn through said eductor and discharged into exhaust flowing through the exhaust muffler; and a vacuum intensifier comprising high pressure air discharging into said central passage from a nozzle mounted through an outer wall of said generally cylindrical body.

18. A railroad locomotive according to claim 17, wherein said high pressure air is furnished by a turbocharger.

19. A railroad locomotive according to claim 17, wherein said muffler is attached to an exhaust outlet of said turbocharger.

* * * * *